US010843031B1

(12) United States Patent
Anne

(10) Patent No.: US 10,843,031 B1
(45) Date of Patent: Nov. 24, 2020

(54) HANDLEBAR ASSEMBLY FOR EXERCISE MACHINE

(71) Applicant: Solidcore Assets, LLC, Washington, DC (US)

(72) Inventor: Mahlum Anne, Washington, DC (US)

( * ) Notice: Subject to any disclaimer, the term of this patent is extended or adjusted under 35 U.S.C. 154(b) by 99 days.

(21) Appl. No.: 15/718,133

(22) Filed: Sep. 28, 2017

Related U.S. Application Data

(60) Provisional application No. 62/409,567, filed on Oct. 18, 2016.

(51) Int. Cl.
*A63B 21/00* (2006.01)
*A63B 22/00* (2006.01)

(52) U.S. Cl.
CPC ..... *A63B 21/4035* (2015.10); *A63B 21/154* (2013.01); *A63B 22/0087* (2013.01); *A63B 2225/09* (2013.01)

(58) Field of Classification Search
CPC ... A63B 21/40; A63B 22/008; A63B 2225/00; A63B 21/01
See application file for complete search history.

(56) References Cited

U.S. PATENT DOCUMENTS 5,391,132 A * 2/1995 Greenwald ..... A63B 23/03533 482/114
5,527,249 A * 6/1996 Harris ..... A63B 21/068 482/57
5,625,923 A * 5/1997 Huang ..... B62B 9/20 16/429
5,935,049 A * 8/1999 Hamm ..... A63B 21/0004 482/108
6,220,995 B1 * 4/2001 Chen ..... A63B 21/02 297/175
6,491,611 B1 * 12/2002 Stearns ..... A63B 21/0552 297/16.1
6,551,226 B1 * 4/2003 Webber ..... F16B 7/105 403/109.3
6,726,608 B1 * 4/2004 Hsu ..... A63B 23/03575 482/121
6,752,747 B2 * 6/2004 Yu ..... A63B 21/00043 482/110
8,632,446 B2 * 1/2014 Solow ..... A63B 21/023 482/130
8,641,585 B2 * 2/2014 LaGree ..... A63B 21/023 482/92

(Continued)

*Primary Examiner* — Garrett K Atkinson
(74) *Attorney, Agent, or Firm* — Garrity Traina, PLLC; Christopher Davis-Traina

(57) ABSTRACT

The present invention relates to an adjustable handlebar for an exercise machine. The handlebar is movable between a plurality of orientations when unlocked, and is held in a substantially secure position when locked. The handlebar generally includes a support attached to the machine. A bar assembly with a handle is slidably disposed through an opening in the support. The adjustable handlebar includes first and second locking devices. An upper portion of the bar assembly is rotatable when a first locking device is unlocked and substantially not rotatable when the first locking device is locked. When both the locking devices are unlocked, the bar assembly is longitudinally slidable for adjusting the height of the handle. When either locking device is locked, the assembly is substantially not slidable.

19 Claims, 7 Drawing Sheets

(56) References Cited

U.S. PATENT DOCUMENTS 8,764,617 B2 * 7/2014 Teeter ..... A61H 1/0292 482/126
9,119,989 B1 * 9/2015 Lagree ..... A63B 21/4001
9,474,924 B2 * 10/2016 Lagree ..... A63B 21/4001
9,522,299 B2 * 12/2016 Lagree ..... A63B 21/0407
9,579,536 B1 * 2/2017 Lagree ..... A63B 21/0407
9,586,081 B2 * 3/2017 Lagree ..... A63B 21/4001
9,597,545 B1 * 3/2017 Lagree ..... A63B 21/15
9,700,775 B2 * 7/2017 Hamilton ..... A63B 69/0002
9,717,945 B2 * 8/2017 Lagree ..... A63B 21/0407
2006/0252613 A1 * 11/2006 Barnes ..... A63B 21/00072 482/95
2009/0048078 A1 * 2/2009 Marcantonio ..... A47K 17/02 482/92
2009/0108648 A1 * 4/2009 Biggs ..... A63B 21/0552 297/217.1
2010/0279827 A1 * 11/2010 Farnsworth ..... A63B 22/02 482/54
2013/0203569 A1 * 8/2013 Athis ..... A63B 21/0552 482/142
2014/0038792 A1 * 2/2014 Farnsworth ..... A63B 22/0012 482/112
2014/0100089 A1 4/2014 Kermath et al.
2015/0165293 A1 * 6/2015 Hamilton ..... A63B 69/0002 473/453
2015/0367166 A1 * 12/2015 Lagree ..... A63B 21/4001 482/123
2016/0256733 A1 * 9/2016 Lagree ..... A63B 21/0407
2017/0036057 A1 * 2/2017 Lagree ..... A63B 21/4001
2017/0072252 A1 * 3/2017 Lagree ..... A63B 21/0407
2017/0100625 A1 * 4/2017 Lagree ..... A63B 21/15
2017/0189740 A1 * 7/2017 Lagree ..... A63B 21/15
2018/0093125 A1 * 4/2018 Johnson ..... A63B 21/15
2019/0255377 A1 * 8/2019 Aronson ..... A63B 21/00065

* cited by examiner

HANDLEBAR ASSEMBLY FOR EXERCISE MACHINE

CLAIM OF PRIORITY

The present non-provisional patent application claims priority to U.S. Provisional Application No. 62/409,567 filed Oct. 18, 2016, which is incorporated herein by reference in its entirety.

BACKGROUND OF THE INVENTION

Field of the Invention

The present application related to an adjustable, locking handle for an exercise machine.

Descriptions of the Related Art

Recent years have seen a surge in the popularity of fitness classes in the United States. Many chose to attend classes at fitness studios as an alternative to the traditional gym experience, which presents members with an often overwhelming array of equipment and little to no instruction.

By contrast, fitness studios who offer classes typically seek to build a community and a relationship between instructors and members. As a result, many find the class type of instruction to be uniquely motivating. In furtherance of these goals, often, the studios are comparatively smaller than traditional gyms. Clients and instructors get to know each other, and the interpersonal relationships strengthen clients' resolve to attend and work toward fitness goals. Some studios even work hard to create a particular ambience through the use of music and décor.

The significant benefits of the size and intimacy of such studios is not without a drawback in terms of floor space. Some studios address this by focusing on only particular types of exercises, such as cycling.

However, other studios overcome the drawback through the use of multi-purpose exercise machines, such as a reformer. Various exercises are often used to target specific muscles or muscle groups. As a result, the equipment employed needs to be adaptable to the exercise to be preformed. These machines often include a variety of apparatuses for gripping by a user.

However, even this approach may have drawbacks. For example, handlebars that may be useful for one set of exercises may be unsuitable or even obstructive when attempting to preform other exercises. Where time and space are at a premium, it is therefore imperative that the machine be easily, and safely, reconfigurable when switching between forms of exercise.

Accordingly, there is a need for an adjustable handlebar for use with an exercise machine, such as but not limited to a reformer. The adjustable handlebar should facilitate a robust combination of configurations that can be quickly, easily, and safely transitioned among. The handlebar assembly should further be strong enough so as to safely bear the weight of a user during exercise.

SUMMARY OF THE INVENTION

An example embodiment of the present invention is directed to an adjustable handlebar for an exercise machine. The handlebar comprises a tubular support structured for attachment to the exercise machine. A longitudinal bar assembly is disposed at least partially within said tubular support.

The longitudinal bar assembly comprises an upper bar and a lower bar. A handle extends radially from the upper bar and is structured for engagement by a user performing an exercise with the machine.

The handlebar further comprises a first locking device that has an unlocked state and a locked state. The upper bar is freely rotatable between a plurality of rotational positions relative to the support when the first locking device is in the unlocked state. The said upper bar is substantially locked in one of said rotatable positions when the first locking device is in the locked state. The first locking device may include a pin that, when locked, engages one of a plurality of apertures in the upper bar. The pin may be biased toward the locked state. Retracting the pin, and moving the assembly, either by rotating the upper bar or sliding the bar assembly, allows a user to alter which of the plurality of apertures is engaged, and thus adjust the orientation of the handle. Upon returning the first locking device to the locked positon, the bar assembly is retained in a substantially non-moving position for use during an exercise.

The adjustable handlebar further comprises a second locking device that has an unlocked state and a locked state. The bar assembly is slidable between a plurality of longitudinal positions relative to the support when the first and second locking devices are both in their respective unlocked state. The bar assembly is substantially locked in one longitudinal positions when the first and second locking devices are in their respective locked state.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Both the foregoing general description and the following detailed description are exemplary and explanatory only and are not restrictive of the invention claimed. As used herein, "or" means "and/or" unless expressly stated otherwise. Furthermore, the use of the singular includes the plural unless specifically stated otherwise, and use of the term "including" as well as other forms, such as "includes," and "included," shall not be considered limiting.

Figure 1:
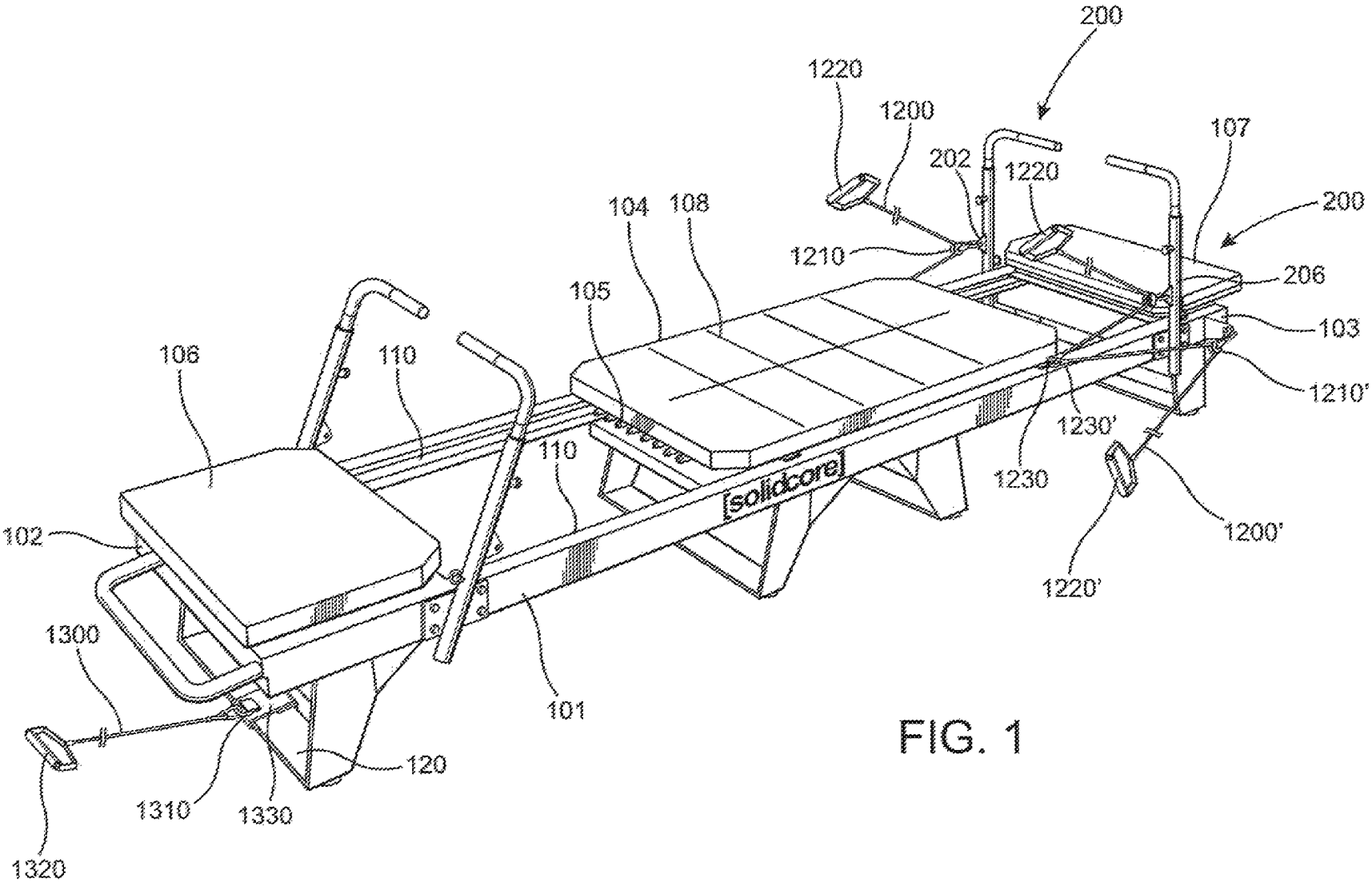
FIG. 1 is a perspective view of an embodiment of the present invention, a plurality of which are attached to an example of an exercise machine.

FIG. 1 provides an example embodiment of the present invention. An exercise machine 100 is depicted. The exercise machine comprises a frame 101 having a first end 102 and a second end 103. A pair of rails 110 are spaced apart and extend the length of the distance between the ends 102, 103. A carriage 104 is attached to the rails 110. The carriage 104 is slidable along substantially the length of the rails 110.

At least one tension member 105 extends from the frame 101 and is removably attached to the carriage 104 so as to bias the carriage 104 toward the first end 102. The tension members 105 may each be capable of providing different resistive forces. Accordingly, a user may change the strength of the biasing force by connecting different ones of the tension members 105, thereby customizing an exercise to match the user's capabilities. In the course of performing an exercise, a user may apply force in a direction opposite that of the resistive force provided by the attached tension members 105.

In addition, a first platform 106 is attached near the first end 102, and a second platform 107 is attached near the second end 103. The platforms 106, 107 may be used during the course of a particular exercise.

The exercise machine further comprises a plurality of adjustable handlebars 200. Though the embodiment of FIG. 1 depicts four such adjustable handlebars 200, other examples of exercise machines may comprise different numbers of adjustable handlebars 200. Additionally, the adjustable handlebars 200 may be provided in corresponding pairs. The adjustable handlebars 200 may also be arranged such that they extend generally toward the carriage 104.

The adjustable handlebar 200 of FIG. 1 comprises a support 206. The support 206 is structured to be affixed to an exercise machine.

An attachment member 202 may be connected to the support 206. The attachment member 202 receives an attachment employed by a user to facilitate an exercise. Without limitation, such an attachment may be a clip, pulley, cable, or any other item or equipment desired by a user. The embodiment of FIG. 1 depicts a pair of pulley assemblies positioned on opposing sides of the exercise machine. Each pulley assembly comprises a handle 1220 for grasping by a user, a cord with two opposing ends 1200, and a pulley 1210. The pulley 1210 is attached to the attachment member 202, and a middle portion of the cord 1200 is routed over the pulley 1210. The handle 1220 is attached to one end of the cord 1200, and the opposite end of the cord 1200 is attached to the carriage 104, such as by way of a clip 1230, though any other suitable structure or method of attachment may be used. Accordingly, to perform an exercise, a user can pull on the handle 1220 to apply force that opposes the resistive force of the tension members 105.

A similarly configured set of outrigger pulley assemblies may also be attached to opposing sides of the machine. Each outrigger pulley assembly comprises a handle 1220' for grasping by a user, a cord with two opposing ends 1200', and a pulley 1210'. The pulley 1210 is attached to an outrigger that extends from the side of the frame 101, and a middle portion of the cord 1200' is routed over the pulley 1210'. The handle 1220' is attached to one end of the cord 1200', and the opposite end of the cord 1200' is attached to a bracket on the carriage 104, such as by way of a clip 1230', though any other suitable structure or method of attachment may be used. Accordingly, to perform an exercise, a user can pull on the handle 1220' to apply force that opposes the resistive force of the tension members 105.

In addition, indicia 108 may be included on the surface of the carriage 104. The indicia may include a plurality of equivalently spaced, transverse lines. These lines may be bisected by a perpendicular line, collectively forming a grid-like image. The indicia 108 facilitate proper and consistent positioning of portions of a user's body when performing an exercise.

Figure 2:
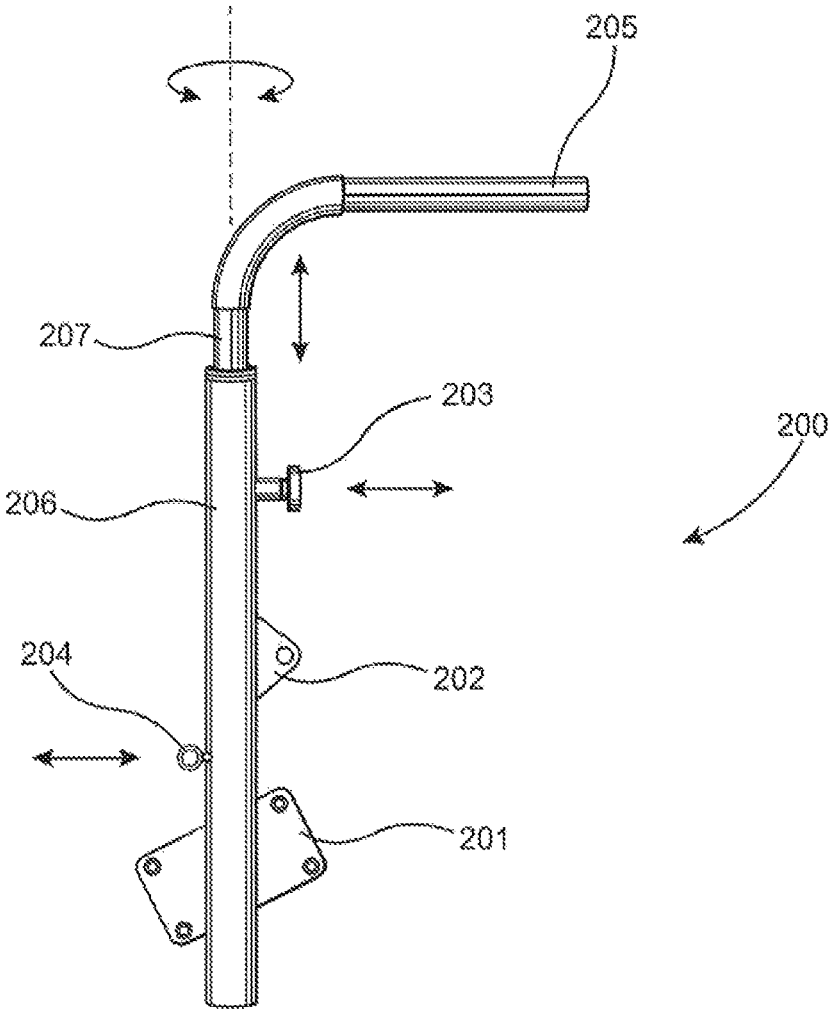
FIG. 2 is a perspective view of an embodiment of the present invention.

As shown in FIG. 2, to facilitate the attachment of the support 106 to the exercise machine, an adjustable handlebar 200 may comprise at least one mount 201. The adjustable handlebar 200 further comprises a bar assembly 207 at least partially disposed within the support 106. The bar assembly 207 comprises a handle 205 for gripping by a user. The handle 205 is movable relative to the support 106. Specifically, the handle 205 is movable along and rotatable about the longitudinal axis of the support 206. Thus, a user may move the handle 205 between a plurality of configurations by moving the handle longitudinally, by rotating the handle, or by performing some combination of the foregoing. This may be desirable when, for example, transitioning from one exercise to another.

The adjustable handlebar 200 further comprises a first locking deice 203 and a second locking device 204. As explained further herein, the locking devices 203, 204 facilitate retention of the bar assembly 207 in one of a plurality of configurations.

Figure 3:
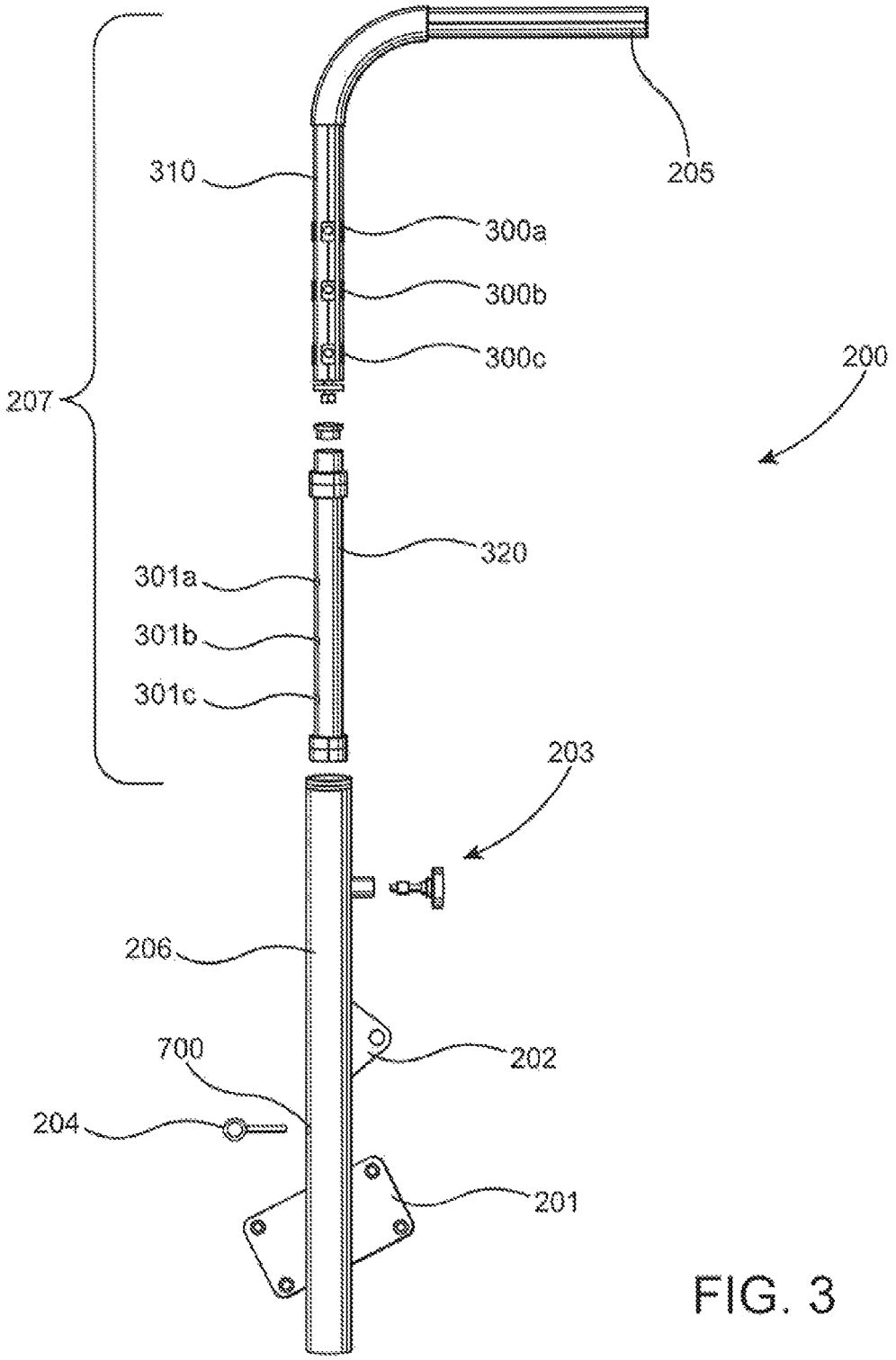
FIG. 3 is an exploded perspective view of an embodiment of the present invention.

FIG. 3 provides an exploded view of the adjustable handlebar 200. In the depicted embodiment, the bar assembly 207 comprises an upper bar 310 and a lower bar 320. The upper bar 310 comprises a plurality of sets of apertures 300*a-c* structured for engagement with the first locking device 203. With reference to the first set of apertures 300*a*, the apertures are radially spaced about the longitudinal axis of the upper bar 310. Four apertures are shown and are uniformly spaced approximately 90 degrees from one another, however any number of apertures and spacing, which may or may not be uniform, may be used.

In the depicted embodiment, the apertures in the second 300*b* and third 300*c* sets are similarly configured to those of the first set 300*a*. However, in alternate embodiments each set 300*a-c* may comprise a differing number of apertures. In addition, the spacing of the apertures may differ from one set to another, and the spacing of a particular set is not necessarily uniform. Though three sets are depicted, in different embodiments the number of sets may vary. Alternatively, instead of apertures, other embodiments may provide for an alternative structure sufficiently configured for engagement with the first locking device 203, such as recesses in the upper bar 310.

The upper bar 310 is attached to the lower bar 320 as explained further below. Further, the upper bar 310 is rotatable relative to the lower bar 320.

The lower bar 320 in the depicted embodiment comprises a plurality of apertures 310*a-c* structured for engagement with the second locking device 204, as described in further detail below. It should further be appreciated that the apertures 301*a-c* may instead be an alternative structure sufficiently configured for engagement with the second locking device 204, such as recesses in the lower bar 320. An aperture 700 in the lower bar 320 facilitates passage of the second locking device 204 through the support 206 so as to engage the lower bar 320.

Figure 4:
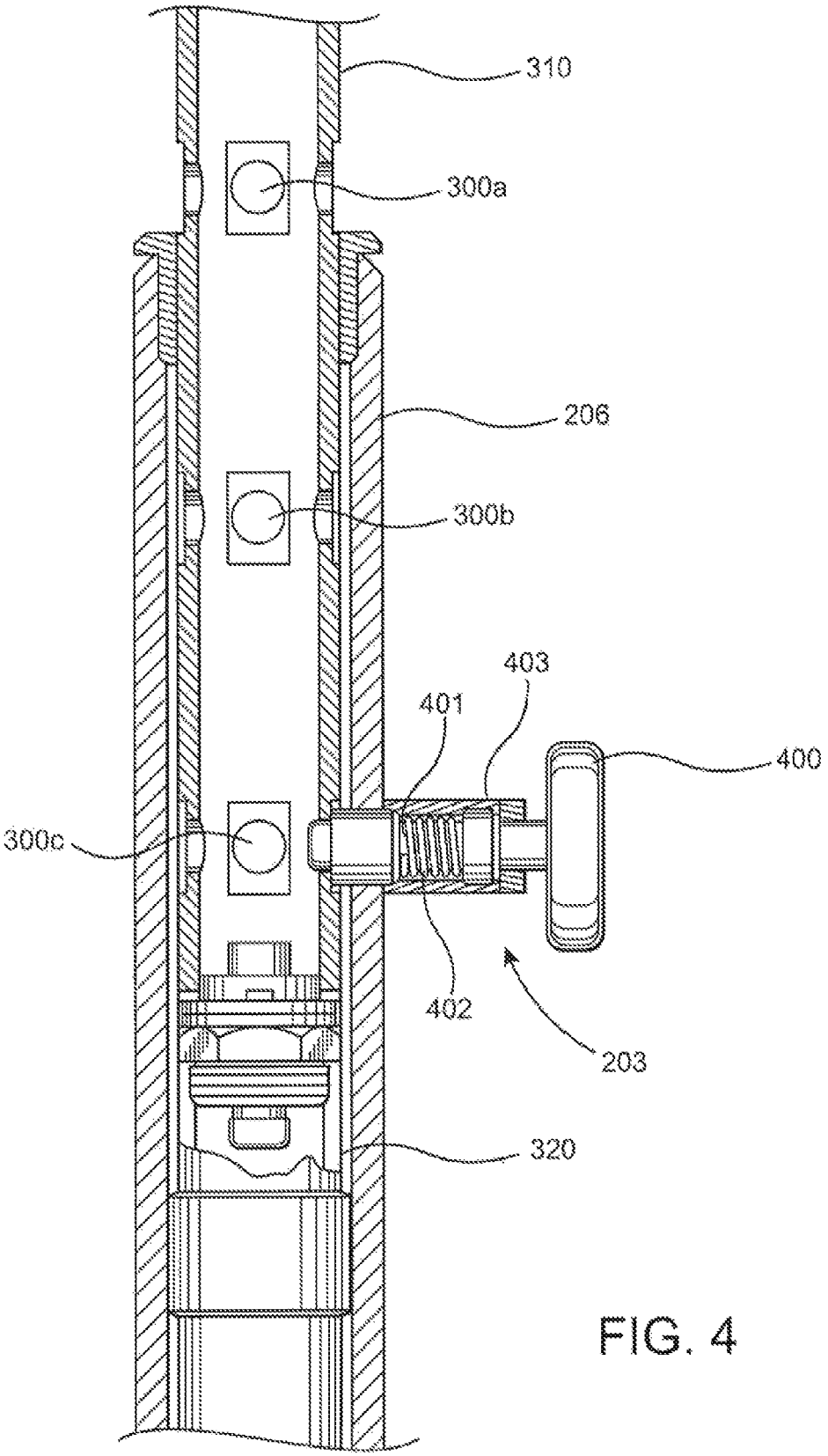
FIG. 4 is a cross-sectional view of an embodiment of the present invention.

With reference to FIG. 4, the internals of the first locking device 203 are shown. The first locking device 203 comprises a housing 403. The housing 403 is attached to the support 206. The housing 403 may be threaded onto the support 206 to facilitate removal, such as in the case of repairs to the adjustable handlebar 200.

The first locking device 203 additionally comprises a pin 401. The pin 401 passes through the housing 403 to engage the upper bar 310. In the depicted embodiment, the pin 401 directly engages one of the sets of apertures 300*a-c* to lockingly engage the upper bar 310.

The first locking device 203 is movable between a locked position and an unlocked position. The locked position is shown in FIG. 4. Retracting the pin 401 from the locking engagement, and thus moving it into the unlocked position, comprises pulling the pin such that it ceases engagement with the upper bar 310.

By retracting the pin 401 from engagement with the upper bar 310, the first locking device 203 is moved to the unlocked position. In the unlocked position, the upper bar 310 is freely rotatable about the longitudinal axis of the support.

In addition, when in the unlocked position, the first locking device 203 does not impede movement of the bar assembly 207 along the longitudinal axis of the support 206.

By applying force to the pin 401 in the direction of the support 206, the pin 401 engages the upper bar 310 and the first locking device 203 is moved to the locked position. A knob 400 may be provided for grasping by the user to assist in moving the pin between the locked and unlocked positions. Additionally, a biasing member 402, such as but not limited to a spring, may be included to bias the pin 401 toward the locked position of the first locking device 203.

The process of adjusting the handlebar 200 is as follows. A user moves the first locking device 203 to the unlocked position so as to disengage the first locking device 203 from the upper bar 310. This withdraws the pin 401 from one of the apertures of the sets of apertures 300*a-c*. The user may then move the handle 205 longitudinally, rotate the handle 205, or perform a combination of the two movements.

The user may then align a different one of the apertures with the pin 401. When only rotating the handle 205, the pin 401 would be realigned with a different one of the apertures in the same set. When moving the handle 205 longitudinally, the pin 401 would be realigned with an aperture of a different set.

The user would then move the first locking device 203 to the locked position. Where a biasing member 402 is present, the user may only release the knob 400 may simply be released, at which point the pin 401 will be forced back toward the upper bar 310 to engage the desired aperture.

Figure 5:
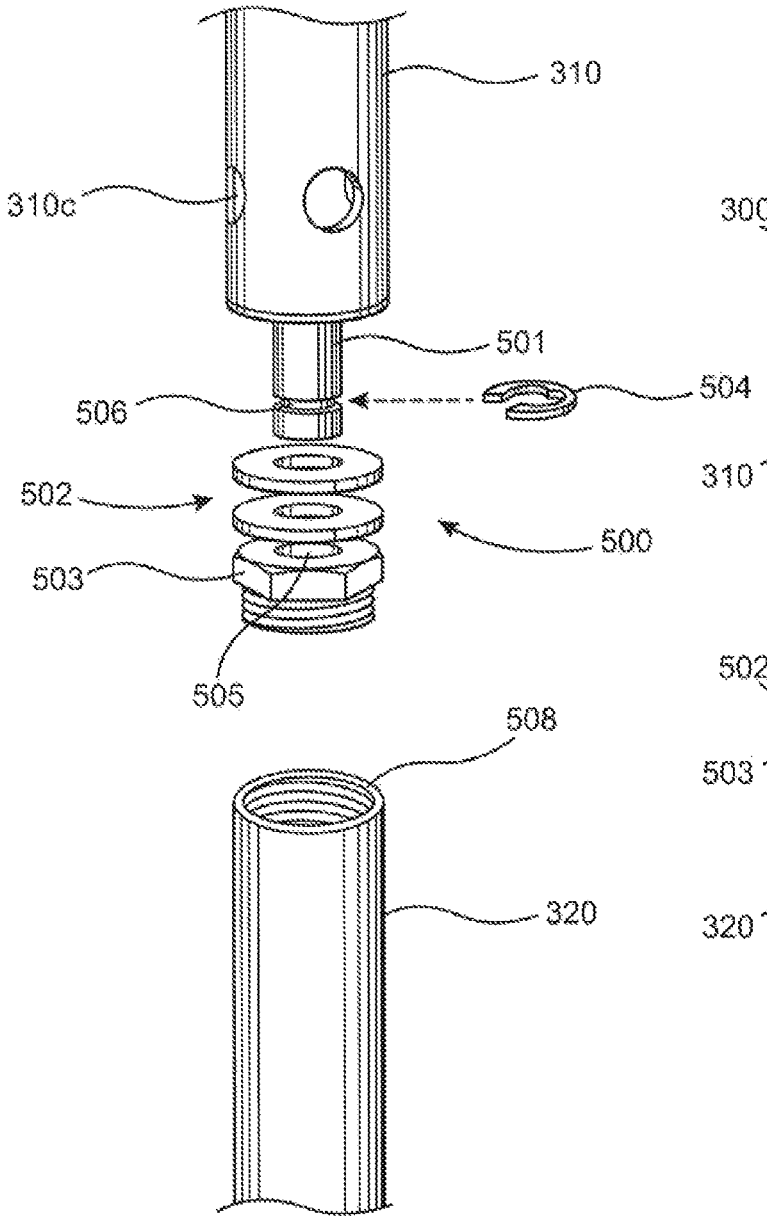
FIG. 5 is an exploded perspective view of an embodiment of the present invention.
Figure 6:
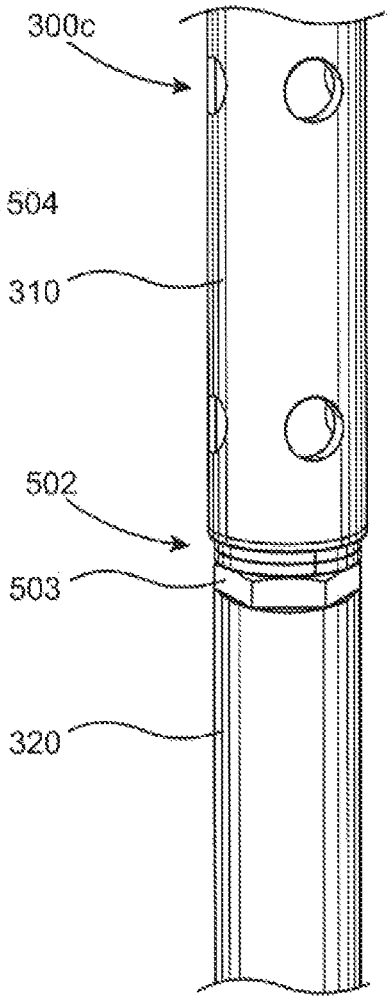
FIG. 6 is a perspective view of the embodiment of FIG. 5.

FIGS. 5 and 6 depict the connection of the upper bar 310 to the lower bar 320. A protrusion 501 extends from the upper bar 310 longitudinally toward the lower bar 320. A threaded cap 503 comprises an aperture 505 to receive the protrusion 501. The protrusion 501 passes substantially through the cap 503.

With primary reference to FIG. 5, a retention device 504, which is substantially wider than the aperture 505, is structured to engage a groove 506 in the protrusion 501. The cap 503 engages threads 508 on the inner surface of the lower bar 320. At least one annular spacer 502, which may be but is not necessarily a washer, may be employed to further facilitate proper disposition of the protrusion 501 relative to the cap 503.

When assembled, as shown in FIG. 6, the upper bar 310 and lower bar 320 are disposed in a locking engagement with respect to the longitude of their axis. Accordingly, adjustment of the handle 205 longitudinally moves both the upper and lower bars 310, 320 in unison relative to the support 206. However, the upper bar 310 remains substantially freely rotatable relative to the lower bar 320.

Figure 7:
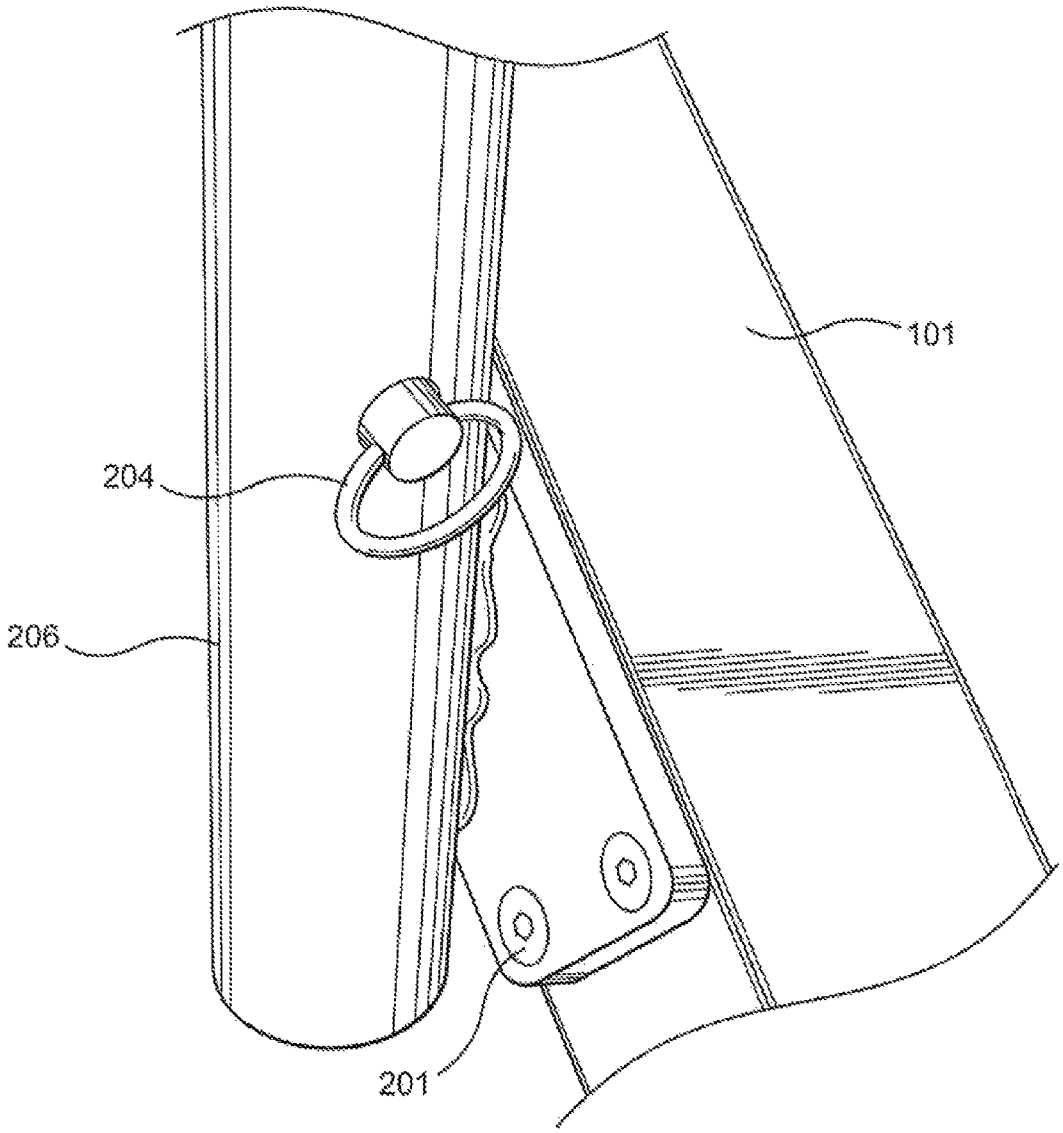
FIG. 7 is a perspective view of an embodiment of the present invention.

FIG. 7 shows the relative disposition of the second locking device 204 and the support 206 when the second locking device 204 is in the locked position.

Figure 8:
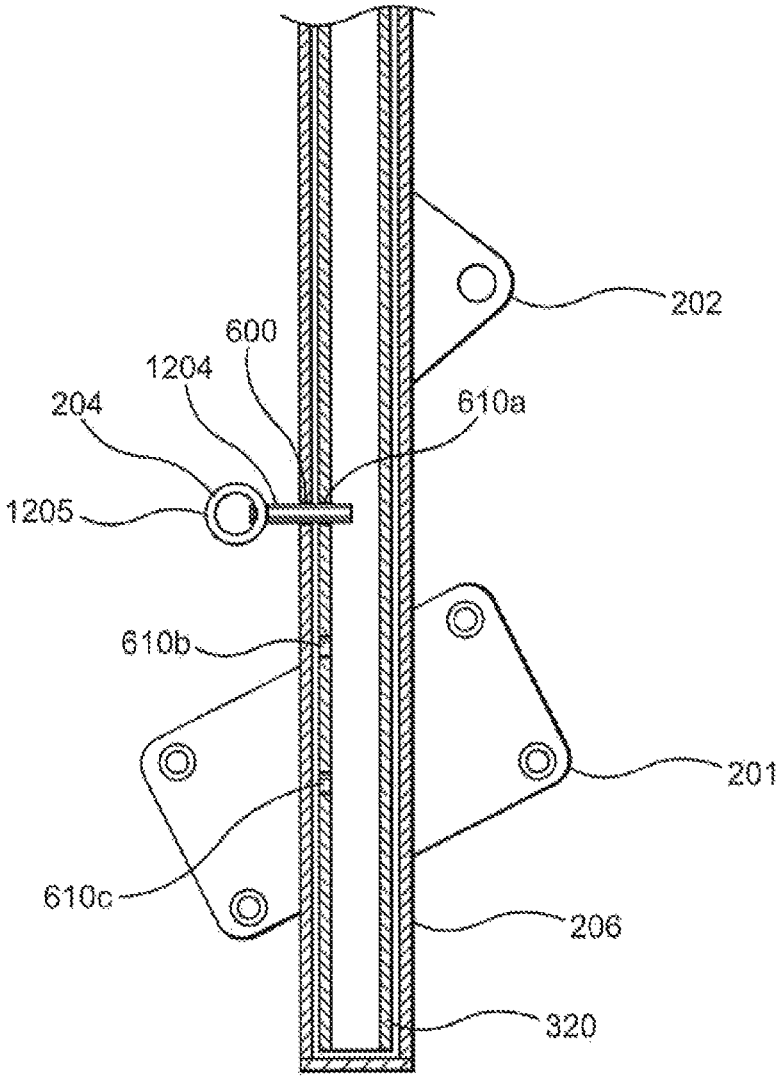
FIG. 8 is a cross sectional view of an embodiment of the present invention.

Further detail of the second locking device 204 in its locked position is provided in FIG. 8. The lower bar 320 is disposed substantially within the support 206. The lower bar 320 comprises a plurality of apertures 610*a-c*. In the depicted embodiment, the second locking device 204 comprises a pin 1204. When in the locked position, the second locking device 204 passes through an opening 600 in the support 206 to engage one of the apertures 610*a-c*.

Retracting the pin 1204 from the lower bar 320 disposes the second locking device 204 in the locked position. When in the unlocked position, the second locking device 204 does not obstruct movement of the lower bar 320 along the longitudinal axis. Once the bar assembly 207 has been adjusted as desired by a user, the pin 1204 is moved back toward the lower bar 320 to engage a desired aperture 610*a-c*. To facilitate ease of adjustment, the second locking device 204 may comprise a ring 1205 for grasping by the user.

In accordance with the foregoing description, a user may dispose the adjustable handlebar 200 in one of a plurality of positions. With further reference to FIGS. 2 and 3, moving the first locking device 203 to the unlocked position provides for rotation of the handle 205. Once rotated to the desired position, returning the first locking device 203 to the locked position substantially prevents rotational movement of the handle 205. In at least one embodiment, this may be achieved without regard to whether the second locking device 204 is in its locked or unlocked position.

The user may adjust the handle 205 longitudinally relative to the axis of the support 206 by disposing both the first 203 and second 204 locking devices in their respective unlocked position. The user may then grasp the handle 205 and move it longitudinally as desired. Since the first locking device 203 is in the unlocked state, the user may simultaneously rotate the handle 205 if desired. Once the handle 205 has been moved to the desired orientation, placing either the first locking device 203 or second locking device 204 in a locked state substantially prevents longitudinal movement.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An adjustable handlebar for an exercise machine comprising:

a support having a longitudinal axis and structured for attachment to the exercise machine, a bar assembly slidably connected to said support, a handle extending outwardly from said bar assembly, a first locking device comprising a pin and having an unlocked state and a locked state, a second locking device having an unlocked state and a locked state, wherein said bar assembly is movable within said support along said longitudinal axis of said support when said first and second locking devices are both in their respective unlocked state, and wherein said bar assembly is unmovable within said support along said longitudinal axis of said support when at least one of said first and second locking devices is in its locked state, and wherein said bar assembly is rotatable about said longitudinal axis of said support, wherein said pin of said first locking device passes through said support to directly engage said bar assembly when in the locked state, and wherein said second locking device directly engages said bar assembly when in the locked state.

2. The adjustable handlebar of claim 1, wherein said bar assembly comprises an upper bar and a lower bar, and said upper bar is rotatable relative to said support.

3. The adjustable handlebar of claim 2, wherein said upper bar is substantially not rotatable when said first locking device is in the locked state, and wherein said upper bar is rotatable when said first locking device is in the unlocked state.

4. The adjustable handlebar of claim 3, wherein said first locking device is attached to said support.

5. The adjustable handlebar of claim 4, wherein said pin of said first locking device passes through said support to directly engage said upper bar when in the locked state.

6. The adjustable handlebar of claim 5 wherein said first locking device further comprises a biasing member connected to said pin of said first locking device, wherein said biasing member applies a biasing force to said pin of said first locking device disposing it toward the locked state.

7. The adjustable handlebar of claim 1, wherein said second locking device comprises a pin.

8. The adjustable handlebar of claim 7, wherein said bar assembly comprises an upper bar and a lower bar, and said pin of said second locking device passes through said support to engage said lower bar when in the locked state.

9. An adjustable handlebar for an exercise machine comprising:

a tubular support having an upper end and a lower end and structured for attachment to the exercise machine, and wherein said upper end comprises an opening, said tubular support also having a longitudinal axis, a bar assembly comprising an upper bar and a lower bar, and being disposed at least partially within said opening of said support, a handle extending outwardly from said upper bar, a first locking device connected to said support and having an unlocked state and a locked state, a second locking device connected to said support and having an unlocked state and a locked state, wherein said second locking device directly engages said bar assembly when in the locked state, wherein said upper bar is rotatable about said longitudinal axis of said support when said first locking device is in the unlocked state, and wherein said upper bar is substantially not rotatable about said longitudinal axis of said support when said first locking device is in the locked state.

10. The adjustable handlebar of claim 9, wherein said upper bar comprises a first set of radially-spaced apertures, and disposition of said first locking device in the locked state comprises the engagement of said first locking device with at least one of said first set of apertures.

11. The adjustable handlebar of claim 10, wherein said upper bar is structured for disposition into a plurality of locked rotational positions relative to said support.

12. The adjustable handlebar of claim 11, wherein the disposition of said upper bar in different ones of said plurality of locked rotational positions comprises the engagement of said first locking device with different ones of said first set of apertures.

13. The adjustable handlebar of claim 10, wherein said bar assembly is slidable within said support when said first locking device is in the unlocked state, and substantially not slidable when said first locking device is in the locked state.

14. The adjustable handlebar of claim 13, wherein said upper bar comprises a second set of radially-spaced apertures.

15. The adjustable handlebar of claim 14, wherein said bar assembly is movable between a first locked longitudinal position and a second locked longitudinal position.

16. The adjustable handlebar of claim 15, wherein said first locking device is structured for engagement with at least one of said first set of apertures when said bar assembly is in said first locked longitudinal position.

17. The adjustable handlebar of claim 14, wherein said first locking device is structured for engagement with at least one of said second set of apertures when said bar assembly is in said second locked longitudinal position.

18. An adjustable handlebar for an exercise machine comprising:

a tubular support structured for attachment to the exercise machine and having a longitudinal axis, a longitudinal bar assembly disposed at least partially within said tubular support, and comprising an upper bar and a lower bar, said upper bar comprising a radially-extending handle, a first locking device comprising a pin and having an unlocked state and a locked state, wherein said pin of said first locking device passes through said support to directly engage said bar assembly when said first locking device is in said locked state, a second locking device comprising a pin and having an unlocked state and a locked state, wherein said pin of said second locking device passes through said support to directly engage said bar assembly when said second locking device is in said locked state, wherein said upper bar is freely rotatable about said longitudinal axis of said support between a plurality of rotational positions relative to said support when said first locking device is in the unlocked state, and wherein said upper bar is substantially locked in one of said rotatable positions when said first locking device is in the locked state.

19. The adjustable handlebar of claim 18, wherein said bar assembly is slidable between a plurality of longitudinal positions relative to said support when said first and second locking devices are both in their respective unlocked state, and wherein said bar assembly is substantially locked in one of said longitudinal positions when said first and second locking devices are in their respective locked state.

* * * * *